United States Patent [19]

Neff

[11] 4,160,352

[45] Jul. 10, 1979

[54] PACKAGING METHOD AND APPARATUS

[75] Inventor: Elias Neff, Yellow Springs, Ohio

[73] Assignee: Antioch Bookplate Company, Yellow Springs, Ohio

[21] Appl. No.: 852,209

[22] Filed: Nov. 17, 1977

[51] Int. Cl.[2] ..... B65B 7/28; B65C 1/02

[52] U.S. Cl. ..... 53/137; 53/209; 53/281; 53/287; 53/306

[58] Field of Search ..... 53/14, 37, 137, 159, 53/207, 209, 249, 250, 281, 282, 287, 288, 306, 312; 156/285, 572; 214/8.5 F

[56] References Cited

U.S. PATENT DOCUMENTS

| | | | |
|---|---|---|---|
| 1,876,191 | 9/1932 | Wolf | 53/288 |
| 1,892,773 | 1/1933 | Kendall | 53/288 |
| 2,006,071 | 6/1935 | Edwards | 156/572 X |
| 2,264,738 | 12/1941 | Blann | 53/306 X |
| 2,712,393 | 7/1955 | Brown | 156/572 |
| 2,934,221 | 4/1960 | Tonna | 214/8.5 F X |
| 3,554,834 | 1/1971 | Bennett et al. | 156/285 X |
| 3,603,462 | 9/1971 | Moser | 53/159 X |
| 3,626,660 | 12/1971 | Dorfmann | 53/287 X |

FOREIGN PATENT DOCUMENTS

| | | | |
|---|---|---|---|
| 211232 | 2/1960 | Austria | 214/8.5 F |
| 1180747 | 2/1970 | United Kingdom | 53/287 |

*Primary Examiner*—John Sipos

*Attorney, Agent, or Firm*—Biebel, French & Nauman

[57] ABSTRACT

Packaging method and apparatus for depositing a predetermined number of sheets, such as bookplates, in a rectangular box bottom having a bottom wall and four upstanding side walls, placing a box top of the same shape but slightly larger size over the box bottom and applying a label to the box top. The box bottoms are conveyed past a loading station at which a predetermined number of bookplates are "extruded" through a slot in a front wall of a hopper, with the height of the slot being adjusted as desired to allow just the desired number of bookplates to be pushed or extruded through it to a box bottom positioned opposite the loading station. As the loaded box bottoms move past the loading station they are intersected by the box tops which move at right angles to the box bottoms and, just before each box top meets a box bottom, the box top leading edge is lifted by means of a suction so that it clears the side wall of the box bottom. The box top is then pushed across the box bottom by a pusher plate until the leading edge of the box tops meets a corresponding side wall of the box bottom, at which point a hinged member urges the box top over the box bottom. As the combined box bottoms and tops with the bookplates contained in them move forward, individual labels depicting the type of bookplates packaged in the boxes are adhesively applied to each box top using air pressure to lift an individual label from a stack of labels and then apply the label to a box top.

8 Claims, 13 Drawing Figures

68
74
46
62
64
42
48
40
36
56
54
58
52
72
82
80
84
70
76
78
28
18
66
44
38

PACKAGING METHOD AND APPARATUS

BACKGROUND OF THE INVENTION

The packaging of small articles in small boxes presents a number of unique problems which heretofore have necessitated that these operations be performed entirely manually. The small boxes involved are used in great quantities and the tolerances in box dimensions are such that they do not lend themselves to handling by precision machinery which would align precisely a box top with a box bottom and then place the box top over the box bottom.

This is particularly true in the packaging of bookplates, which may be packed fifty to a box in quantities of several hundred thousand. In such operations loading the correct number of bookplates in each box bottom and then placing a box top over the box bottom appears deceptively simple, yet in fact it is difficult to the point that no prior art system other than a manual one appears to perform satisfactorily.

As a result of the difficulties encountered in packaging materials in small boxes in great quantities, particularly in packaging thin sheets of material such as bookplates in small boxes on a high volume basis, such packaging operations have become highly labor intensified with each of these operations being accomplished manually.

SUMMARY OF THE INVENTION

The present invention provides an automated system of packaging on a high volume basis in a manner which accommodates the small size of the boxes used in packaging and the dimensional variations normally encountered in such boxes.

Thus, packaging apparatus in accordance with the present invention provides conveyors for conveying box tops and bottoms along intersecting paths with the movement of the box components synchronized such that they are aligned at their paths of intersection. As they intersect, means is provided for raising the leading edge of, for example, the box top, so that as it is pushed forward across the path of the box bottoms the lower edge of its leading side wall slides across the edges of the upstanding side walls of the box bottom, guiding the box bottom side walls into the box top side walls and accommodating any irregularities in the box components caused by manufacturing and any tendency of the box component side walls to bulge.

Preferably, the leading edge of the box top is raised through the application of negative pressure and the influence of the negative pressure on the box top is broken as the box top moves forwardly across the box bottom by providing a downwardly inclined edge adjacent the source of negative pressure. Thereafter, as the leading side wall of the box top moves past a corresponding side wall of the box bottom a hinged member urges the box top down onto the box bottom.

Where the articles being packaged are thin sheet-like members, such as bookplates, a special loading station is provided for, in effect, extruding from a stack of such sheets a predetermined number thereof into a box bottom positioned at the loading station.

The loading station comprises a hopper having a front wall and a bottom wall, with the front wall provided with a slot extending upwardly from the bottom wall a distance approximately equal to or preferably slightly greater than the thickness of the number of sheets desired to be loaded into a box bottom. In the case of bookplates, the slot or opening in the front wall is preferably one or two sheets higher than the number of sheets desired to be pushed through the slot. A pusher plate of approximately the same thickness as the number of sheets to be loaded slides across the bottom wall pushing the sheets before it through the slot in the front wall and into a box bottom.

In accordance with the present invention, a label applying station can be positioned downstream to apply a label to a box top after the box top has been placed over a box bottom. The labelling station includes a vacuum pick-up for removing a label from a stack of such labels, means for moving the pick-up across a liquid applicator to render adhesive the lower face of the label, and a positive air supply for pressing the adhesive coated label onto a box top.

To insure optimum efficiency of a total machine which includes a loading station, an assembly station and a label applying station, a single drive source is utilized from which all of the components are driven in synchronization to insure that a box bottom is positioned at the loading station as a predetermined number of sheets are extruded therefrom, that the box tops and bottoms are aligned at the intersection of their paths, and that a box top is in position to receive a gummed label at the labelling station.

While the total machine includes the three stations described above, it will be apparent that it may be desirable to utilize any one of them independently of the others and/or in conjunction with conventional mechanical or manual operations.

Regardless of this, it will be seen from the above and following detailed description that the present invention provides a packaging method and apparatus which may be used to eliminate substantially all manual operations associated with the prior art packaging operations of this type.

DESCRIPTION OF THE PREFERRED EMBODIMENT

Figure 1:
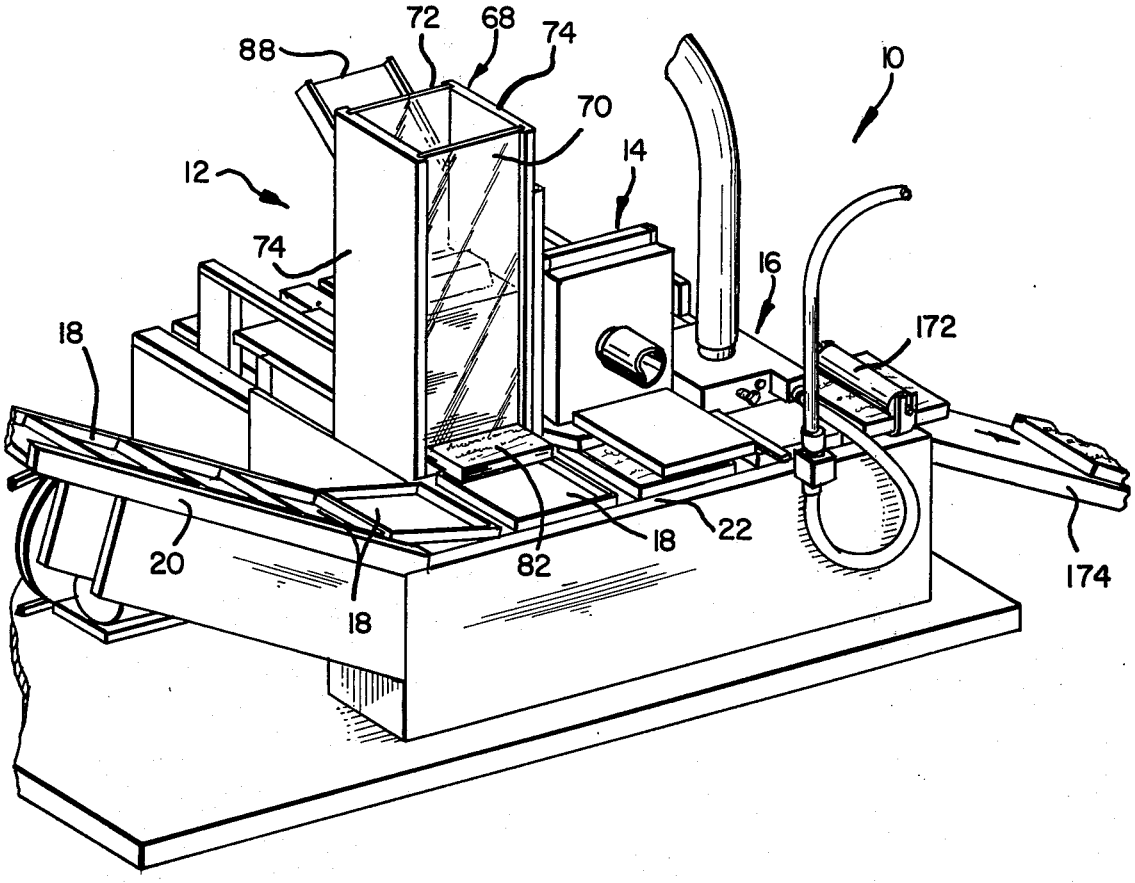
FIG. 1 is a pictorial view of a machine embodying the present invention.

As seen in FIG. 1 of the drawings, apparatus 10 in accordance with the present invention includes a loading station 12 and assembling station 14 and a labelling station 16. Box bottoms 18 are loaded from any convenient source onto an inclined ramp 20, from the lower end of which they are picked up by a reciprocating, horizontal box bottom conveyor 22.

Figure 2:
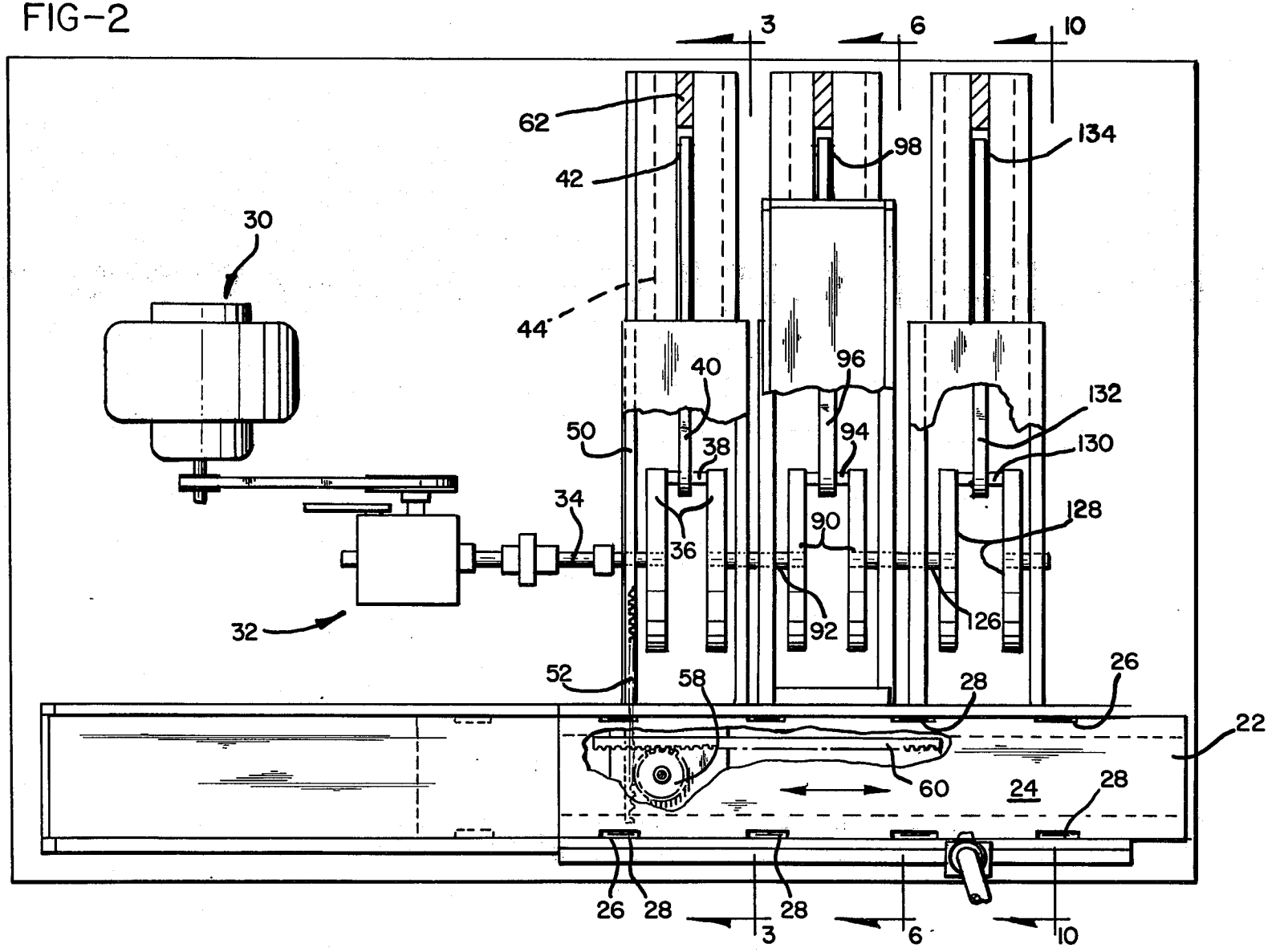
FIG. 2 is a plan view of a portion of the machine of FIG. 1 with portions broken away to show the underlying drive and synchronizing mechanism.

With reference to FIGS. 1 through 5 of the drawings, it will be seen that the conveyor 22 includes a flat, horizontal plate 24 having pivotally mounted thereon within slots 26 formed along opposite edges thereof dogs 28 which are pivoted such that they can move clockwise as plate 24 moves to the left as seen in FIG. 2 of the drawings but remain upright and engage rear edges of box bottoms 18 as the plate 24 moves to the right as seen in FIG. 2 of the drawings. In this way, the box bottoms received off the ramp 20 are moved in an incremental fashion downstream through the packaging apparatus.

To drive the conveyor 22 a motor 30 is connected to a reduction unit 32 to power a drive shaft 34 directly coupled to a pair of interconnected discs 36. Discs 36 are joined by a rod 38 which passes through an opening in a link 40 which is pinned at 42 between a pair of spaced, vertical plates 44 which reciprocate horizontally between spaced upper plates 46 and a lower plate 48.

Figures 3, 4, 5:
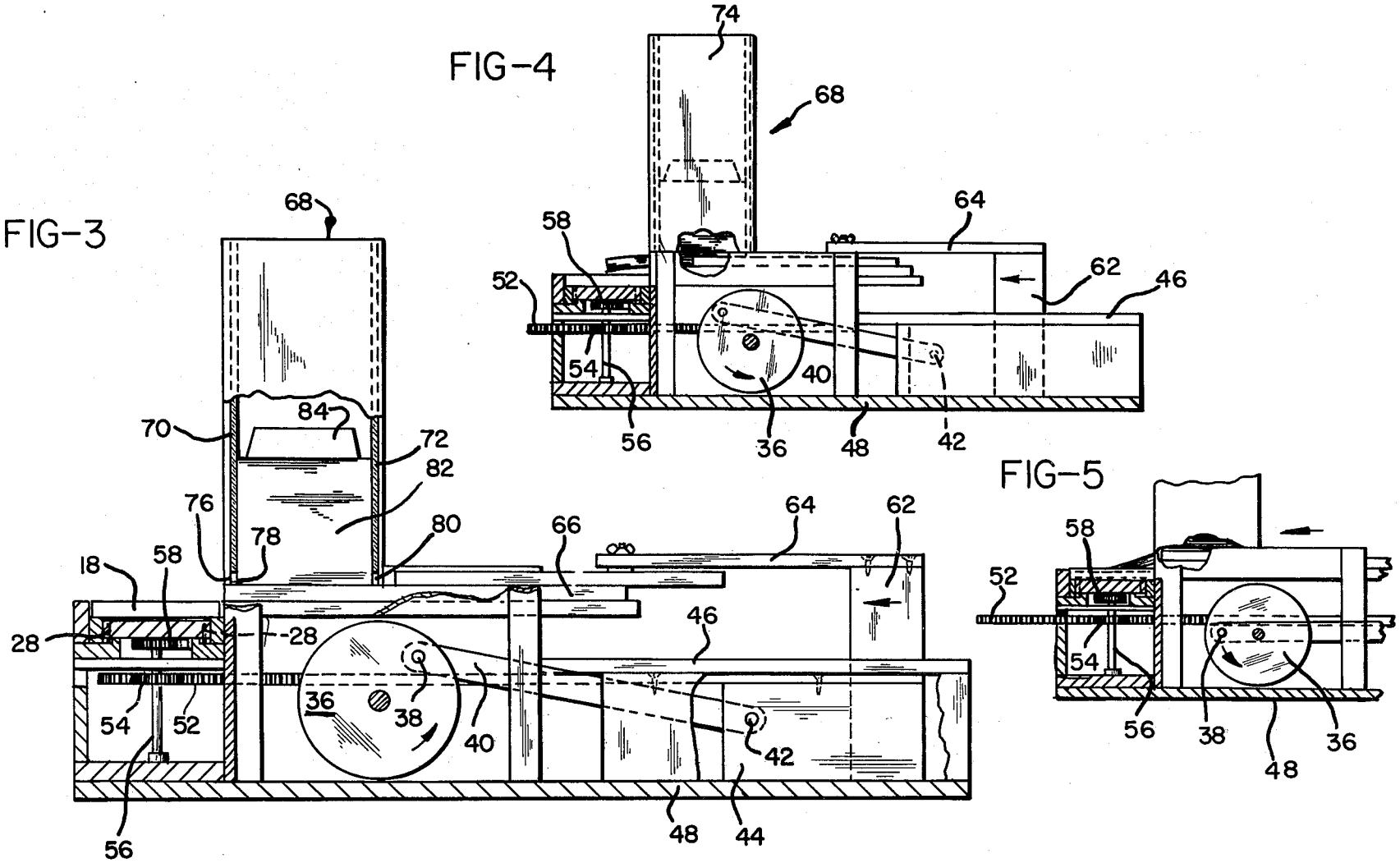
FIG. 3 is a view taken along line 3—3 of FIG. 1 and showing the loading station.
FIG. 4 is a view similar to FIG. 3, but showing the loading station at a different phase of operation.
FIG. 5 shows a portion of the loading station at still another stage of operation.

The left hand vertical plate 44 as seen in FIG. 2 of the drawings has fixed to it an elongated rod 50 which is toothed at its end extending beneath the conveyor 22 to form a rack 52. Rack 52 meshes with a pinion 54, as best seen in FIGS. 3 through 5 of the drawings, carried by a rotatably mounted shaft 56, which also has fixed to it an upper pinion 58. Pinion 58, as best seen in FIG. 2 of the drawings, meshes with a rack 60 fixed to the under surface of the reciprocating plate 24, so that rotation of the discs 36 results in reciprocal movement of the plate 24 in the direction indicated by the double headed arrow shown in FIG. 2 of the drawings.

Spaced, vertical plates 44 have fixed between them an upstanding vertical plate 62 which in turn carries a horizontal, reciprocating plate 64, attached to an outer end of which is a pusher plate 66 for a purpose presently to be described.

The loading station 12 includes a hopper 68 having a front wall 70, a rear wall 72 and side walls 74. The front wall of the hopper is provided with a slot 76 having a height extending from a bottom wall 78 approximately equal to the thickness of the number of bookplates it is desired to load into a box bottom 18, and preferably of a height equal to the thickness of one or two more bookplates greater than the thickness of the desired load of bookplates. The back wall 72 is also slotted as indicated at 80 to receive the pusher plate 66.

With this construction it will be seen that as the box bottoms 18 slide down the ramp 20 they are picked up between pivoted dogs 28 on the plate 24 and moved incrementally past the loading station 12 where a supply of bookplates 82 is stacked in the hopper 68 and weighted down by a weight 84. The pusher plate 66 moves forwardly through the slot 80 in the rear wall 72 and pushes through the slot 76 in the front wall the desired number of bookplates 82 into a box bottom 18 positioned in front of the loading station 12. Because the pusher plate 66 and the conveyor plate 24 are operated from the same drive, they can be synchronized readily to assure that a box 18 is positioned in front of the loading station each time a stack of bookplates are extruded out of the hopper.

As the box bottoms 18 each with a load of bookplates 82 move downstream their path intersects the path of a supply of box tops 86 (see FIGS. 7 through 9) moving down an inclined ramp 88 along a path intersecting the path of movement of the box bottoms.

As seen in FIG. 2 of the drawings, one of the discs 36 is fixed in an adjoining disc 90 by means of a shaft 92 and the disc 90 is in turn attached to an identical disc 90 by a pin 94 which is loosely received in one end of a link 96.

Figure 7:
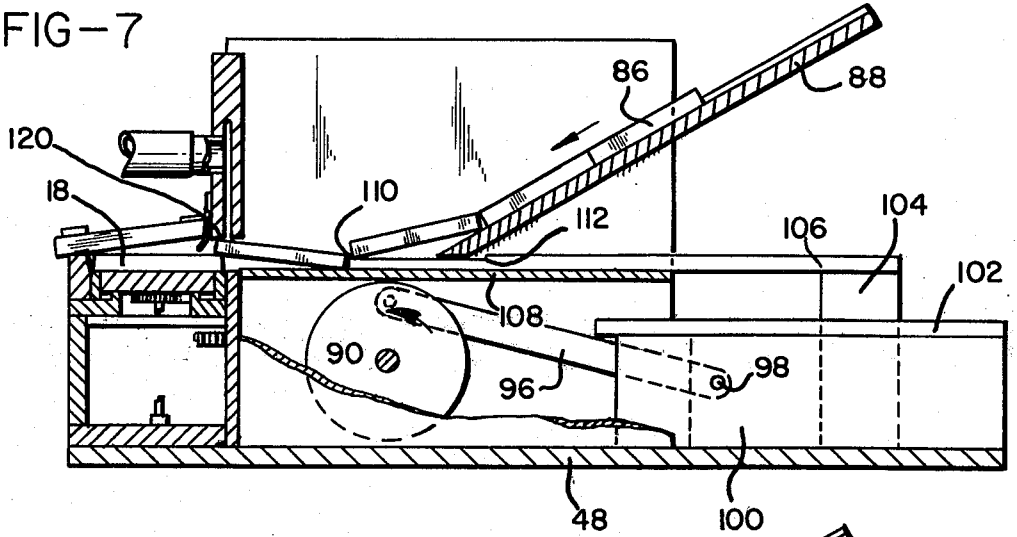
FIG. 7 is a view similar to FIG. 6, but showing the assembling station at a different phase of operation.
Figure 6:
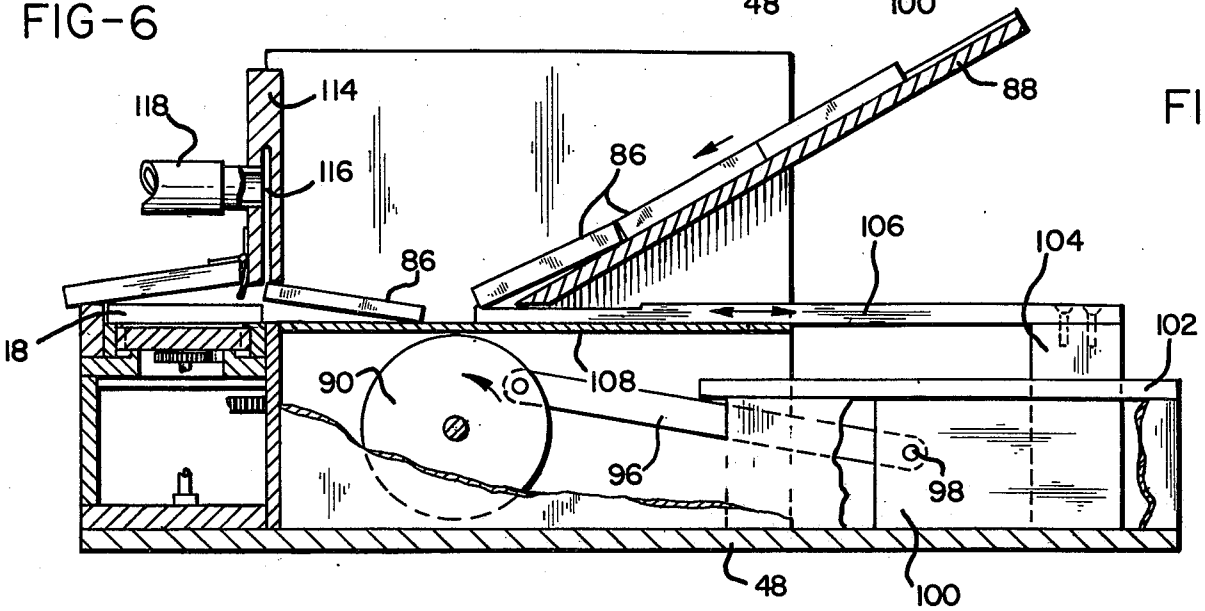
FIG. 6 is a view taken along line 6—6 of FIG. 2 and showing the box component assembling station.

The rearward end of the link 96 is pinned as at 98 to a pair of spaced vertically extending side plates 100, as seen in FIGS. 6 and 7, which slide between the lower plate 48 and a pair of upper plates 102. The side plates 100 have secured between them a vertically upstanding plate 104 which carries a forwardly projecting pusher plate 106, which slides at its forward end on a table 108. The extreme forward end of the pusher plate 106 is slightly upturned as seen at 110 and is notched at 112.

With this construction as the plate 106 reciprocates toward and away from the conveyor 22 it allows a first box top 86 to slide off the ramp 88 into the area between the upturned portion 110 and the notch 112. Then as the plate 106 moves to the right as seen in FIGS. 6 and 7 the box top carried by it slides off as its rear end engages the lower end of the ramp 88. Reverse movement of the plate 106 to the left then causes the box top deposited on the table 108 to be slid forward as a succeeding box top is simultaneously picked up between the upturned portion 110 and notch 112 of the plate 106.

The front wall 114 of station 14 is hollow as seen at 116 and connected as at 118 to a source of negative pressure. Therefore, as a box top reaches the wall 114 its leading edge is elevated as seen in FIG. 6 of the drawings so that it clears a box bottom positioned at station 14. Movement of the plate 106 to the left to the position shown in FIG. 7 of the drawings causes the box top to engage the downwardly inclined edge 120 of the wall 114, breaking the influence of the negative pressure on the box top and causing it to engage the upper edges of the side walls of the box 18.

Figure 8:
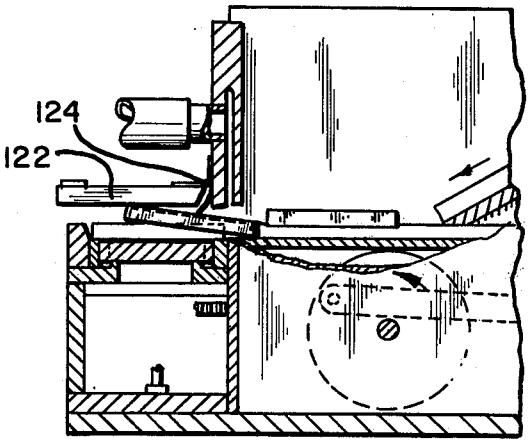
FIGS. 8 and 9 are partial views of the assembling station showing additional steps in its operation.

Continued movement to the left of the plate 106 to the position shown in FIG. 8 causes the leading side wall of the box top to ride along the upper edges of the side walls of the box bottom, automatically guiding the side walls of the box bottom between the side walls of the box top. In this way any irregularities in box construction and bulging of the side walls of the box tops and bottoms is readily accommodated.

Figure 9:
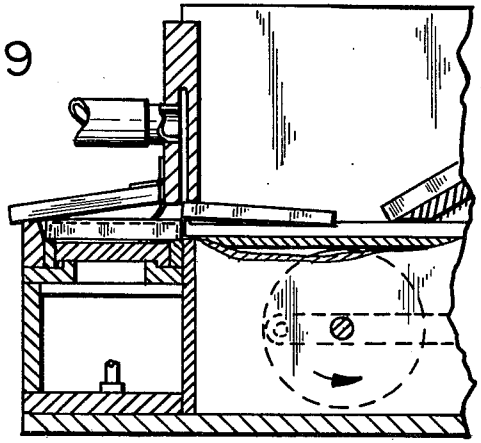

As the box top moves over the bottom it is urged downwardly by the pivoted member 122, which is pivoted at 124 to the front wall, so that as the box top reaches the position shown in FIG. 9 of the drawings where its leading edge has moved beyond the corresponding wall of the box bottom, it is pushed down into position enclosing the box bottom therein.

As in the case of the loading station, a common drive is utilized for the movement of the box bottoms along their path and movement of the box tops along a corresponding path so that the tops and bottoms meet at the intersection of their paths.

Turning next to FIGS. 1, 2 and 10 through 13 of the drawings, the labelling station shown at 16 in FIG. 1 will be described. A shaft 126 interconnects one of the discs 90 and a disc 128, which is in turn connected to a similar disc 128 by a pin 130. Pin 130 is loosely received in a link 132 which carries a pin 134 at its opposite end attached to upstanding side plates 136 slidably mounted between the lower plate 48 and a pair of spaced apart top plates 138.

The side plates 136 have fixed between them an upstanding vertical plate 139 which carries a forwardly projecting member 140 to which is attached an arm 142 fixed to a plenum chamber 144. It will thus be seen that rotation of the discs 128 causes the plenum chamber 144 to reciprocate between right and left hand positions as shown in FIGS. 10 through 13 of the drawings.

Plenum chamber 144 is hollow and is provided with a perforated lower plate (not shown). The interior of the chamber 144 is connected to a source of vacuum 146 and a source of positive pressure 148. Suitable valving structure within the plenum 144 is operable to cause positive or negative pressure to be imposed upon the interior of the chamber 144, and the valving structure is controlled by valve stems 150 and 152 which project from opposite ends of the chamber 144 and are adapted to engage stops 154 and 156 at opposite ends of the path of travel of the plenum 144.

Figure 10:
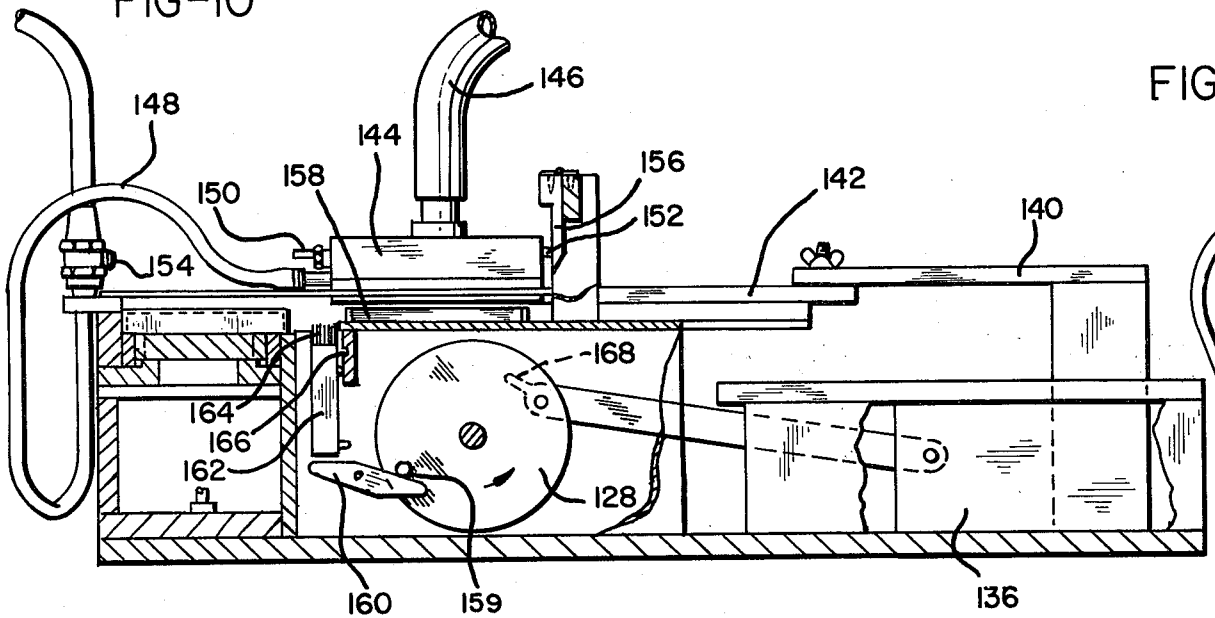
FIG. 10 is a view taken along line 10—10 of FIG. 2 and depicting the labelling station.

A stack of labels 158, which conventionally may be the bookplates being packaged, are held in a stack at the right hand end of the path of travel of the plenum 144 and as the plenum 144 moves to the position shown in FIG. 10 of the drawings, the valve stem 152 actuates the valving mechanism within the plenum 144 to cause a negative pressure to be applied to the plenum and the uppermost one of the labels in the stack to be lifted from the stack.

The plenum then begins to move to the left as seen in FIGS. 10 through 13 under the influence of the counterclockwise rotating discs 128. As the discs 128 rotate a pin 159 projecting from one face of the right hand disc as seen in FIG. 10 engages a pivoted lever 160 which in turn causes a liquid filled tank 162 and brush 164 to move vertically upwardly. The wetted brush 164 thus engages the lower surface of the label carried by the plenum 144 as the plenum moves to the left, rendering the face of the label adhesive.

Figure 12:
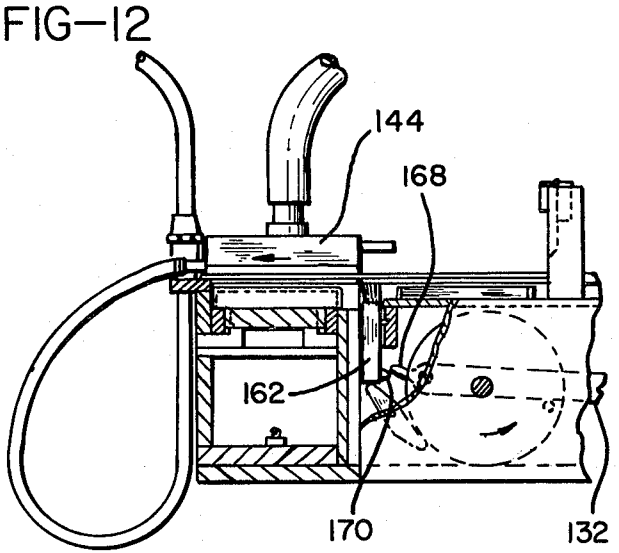
FIGS. 12 and 13 are partial views of the labelling station showing still further steps in its operation.
Figure 13:
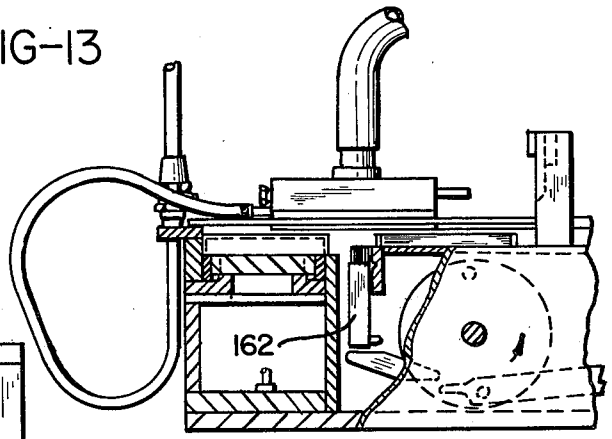
Figure 11:
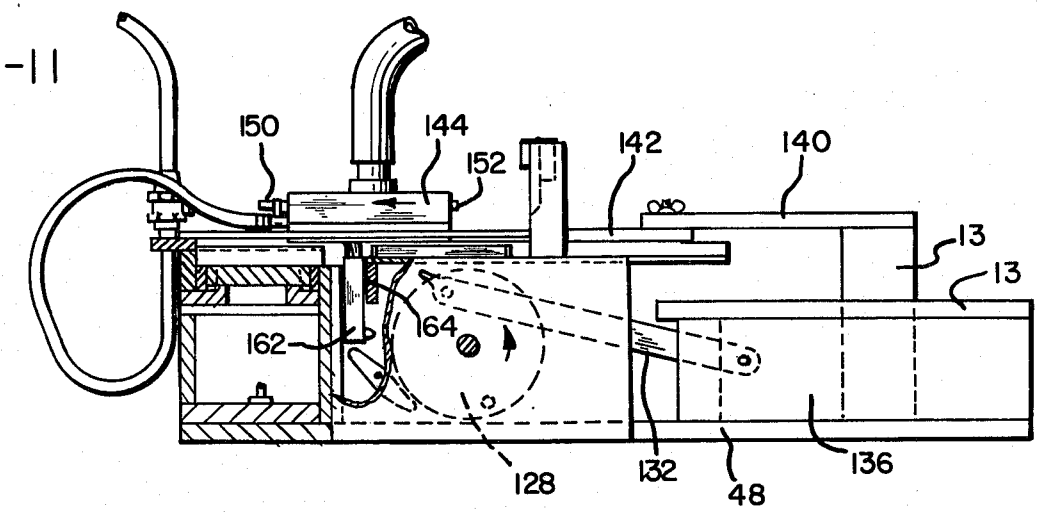
FIG. 11 is a view similar to FIG. 10 and showing the labelling station at a different stage of operation.

When the plenum moves to the position shown in FIG. 12 of the drawings the valve stem 150 engages the stop 154, causing a blast of positive air pressure to disengage the label carried by the plenum 144 and press it firmly on the box top positioned beneath the plenum. When the tank 162 is moved to its uppermost position a ball 164 carried by the tank engages in a complementary detent 166 to hold the tank in its raised position. To lower the tank back to the position shown in FIG. 10 of the drawings the link 132 is provided with a nose 168 which engages a strike 170 carried by the tank and moves the tank downwardly as seen in FIG. 13 of the drawings.

As in the case of the operations performed at stations 12 and 14 the label application is synchronized with the movement of the conveyor 22 by virtue of the fact that the same drive system is used for all operating components of the system.

As seen in FIG. 1 of the drawings, following application of a label to a box top the conveyor 22 carries the filled, labelled box beneath a pressure roller 172, from whence the boxes travel down an inclined chute 174 for subsequent handling.

From the above, it will be seen that the present invention provides method and apparatus for packaging which eliminates conventional manual operations and permits continuous high volume production.

While the method herein described, and the form of apparatus for carrying this method into effect, constitute preferred embodiments of the invention, it is to be understood that the invention is not limited to this precise method and form of apparatus, and that changes may be made in either without departing from the scope of the invention.

What is claimed is:

1. Packaging apparatus comprising:

means for conveying a first box component along a first path, means for conveying a second box component along a second path intersecting said first path, said box components including main wall portions and side wall portions projecting from said main wall portions and one of said box components being smaller than and receivable in the other of said box components, means for synchronizing movement of said box components along their respective paths such that said components are aligned at the intersection of their paths, means for imposing a negative pressure above a leading edge of one of said components as it reaches the intersection of the paths of said components for raising the leading edge of said one of said components such that the adjacent side wall portions of said components are clear of each other, said means for conveying said second box components including a pusher plate for pushing individual ones of said second box components across the path of said first box components and thereby sliding said individual ones of said second box components across individual ones of said first box components, and means urging said individual ones of said second box components down onto said individual ones of said first box components.

2. The apparatus of claim 1 further comprising:

means for deflecting said raised leading edge of one of said components downwardly into engagement with the other of said components as said one of said components is pushed across said path of said other of said components.

3. The apparatus of claim 2 further comprising:

a loading station for depositing a predetermined number of sheets into said first box components upstream of the intersection of the paths of said first and second box components.

4. The apparatus of claim 3 wherein said loading station comprises:

a hopper having a bottom wall, a front wall and upstanding side walls, said front wall of said hopper having an opening therein extending upwardly from said bottom wall a height approximately equal to the thickness of said predetermined amount of sheets, a pusher plate of approximately the same height as said predetermined number of sheets adapted to slide between said upstanding side walls of said hopper and push through said opening in said front wall of said hopper said predetermined number of sheets, and means for synchronizing movement of said pusher plate with movement of said conveyor for said first box components such that said box components are aligned with said pusher plate when said pusher plate pushes said predetermined number of sheets through said opening in said front wall of said hopper.

5. The apparatus of claim 4 further comprising:
means for applying labels to said second box components after they have been placed over said first box components.

6. The apparatus of claim 5 wherein said label applying means comprises:
means for removing a label from a stack thereof,
means for positioning a removed label over a second box component,
means for applying a liquid to a surface of said label to cause it to adhere to said second box component, and
means for pressing a label to a second box component to cause it to adhere thereto.

7. The apparatus of claim 6 wherein:
said means for removing a label and said means for pressing a label to a second box component are fluid pressure actuated.

8. Packaging apparatus comprising:
means for conveying a succession of box bottoms each having a bottom wall and upstanding side walls along a first horizontal path,
means for conveying a succession of box tops along a second path intersecting said first horizontal path,
said box tops being of substantially the same shape as but larger than said box bottoms and adapted to receive said box bottoms therein,
said box bottom conveyor including a reciprocating plate having upstanding dogs adapted to engage trailing edges of said box bottoms upon forward movement of said plate and to pivot out of operative engagement with said box bottoms upon rearward movement of said plate,
means positioned adjacent the intersection of said paths of said box tops and box bottoms for imposing a reduced pressure above said box tops adjacent a leading edge thereof to elevate said leadng edge of said box top a distance sufficient to clear said leading edge of said box top with respect to the upstanding wall of one of said box bottoms aligned with said box top,
said box top conveying means including a pusher plate for pushing individual box tops across the path of said box bottoms,
means synchronizing said pusher plate with said reciprocating plate such that box bottoms and box tops are aligned at the point of the intersection of their paths,
means for deflecting said box top downwardly away from said negative pressure source as said pusher plate moves said box top across a box bottom such that said box top slides across said box bottom, and
means urging said box top down about said box bottom.

* * * * *